US012497747B2

(12) United States Patent
Träskelin et al.

(10) Patent No.: US 12,497,747 B2
(45) Date of Patent: Dec. 16, 2025

(54) FOUNDATION FOR AN OFFSHORE STRUCTURE AND METHOD FOR INSTALLING A FOUNDATION

(71) Applicant: ELOMATIC OY, Turku (FI)

(72) Inventors: Olavi Träskelin, Pori (FI); Antti Ajosmäki, Pori (FI); Sakari Oja, Pori (FI)

(73) Assignee: ELOMATIC OY, Turku (FI)

( * ) Notice: Subject to any disclaimer, the term of this patent is extended or adjusted under 35 U.S.C. 154(b) by 355 days.

(21) Appl. No.: 18/261,511

(22) PCT Filed: Jan. 24, 2022

(86) PCT No.: PCT/FI2022/050042
§ 371 (c)(1),
(2) Date: Jul. 14, 2023

(87) PCT Pub. No.: WO2022/162274
PCT Pub. Date: Aug. 4, 2022

(65) Prior Publication Data

US 2024/0084542 A1 Mar. 14, 2024

(30) Foreign Application Priority Data

Jan. 27, 2021 (FI) ..... 20215088

(51) Int. Cl.
*E02D 27/52* (2006.01)

(52) U.S. Cl.
CPC ..... *E02D 27/525* (2013.01)

(58) Field of Classification Search
CPC ..... E02D 27/525
See application file for complete search history.

(56) References Cited

U.S. PATENT DOCUMENTS 9,096,985 B1 * 8/2015 Phuly ..... E02D 27/08
10,107,265 B2 * 10/2018 Lafferty ..... E02D 27/42
(Continued)

FOREIGN PATENT DOCUMENTS

CN 106759419 A 5/2017
CN 107882058 A 4/2018
(Continued)

OTHER PUBLICATIONS

International Search Report and Written Opinion received for PCT Serial No. PCT/FI2022/050042 on Apr. 28, 2022, 11 pgs.
(Continued)

*Primary Examiner* — Kyle Armstrong
(74) *Attorney, Agent, or Firm* — Merchant & Gould P.C.

(57) ABSTRACT

A foundation is for an offshore structure. The foundation includes a wall forming a closed perimeter and a top deck attached to the upper end of the wall, wherein the wall and the top deck define a downwardly open hollow space. The wall includes a plurality of wall sections. Each wall section has a first elongated hollow body and a second elongated hollow body arranged inside the first elongated hollow body. The lower end of the first elongated hollow body is closed by an end member that is provided with an opening through which the lower end of the second elongated hollow body is arranged to extend. A method is for installing a foundation into the ground.

13 Claims, 2 Drawing Sheets

(56) References Cited

U.S. PATENT DOCUMENTS

| | | | | |
|---|---|---|---|---|
| 2008/0260468 | A1 | 10/2008 | Heskin | |
| 2024/0392526 | A1* | 11/2024 | Bartminn | ..... E02D 15/08 |

FOREIGN PATENT DOCUMENTS

| | | | | | |
|---|---|---|---|---|---|
| CN | 108842798 | A | | 11/2018 | |
| GB | 628123 | A | | 8/1949 | |
| GB | 2264733 | A | | 9/1993 | |
| KR | 20160139283 | A | * | 12/2016 | ..... E02D 27/425 |
| KR | 20180057090 | A | * | 5/2018 | ..... E02D 5/223 |
| KR | 20180084411 | A | | 7/2018 | |
| WO | 2019034616 | A1 | | 2/2019 | |

OTHER PUBLICATIONS

Finnish Office Action received for FI Serial No. 20215088 on Aug. 26, 2021, 5 pgs.

* cited by examiner

FOUNDATION FOR AN OFFSHORE STRUCTURE AND METHOD FOR INSTALLING A FOUNDATION

CROSS-REFERENCE TO RELATED APPLICATIONS

The present application is a National Stage Filing of PCT International Application No. PCT/FI2022/050042 filed on Jan. 24, 2022, which claims priority to Finnish application No. 20215088, filed with the Finnish Patent Office on Jan. 27, 2021, which applications are incorporated herein by reference in their entirety.

TECHNICAL FIELD OF THE INVENTION

The present invention relates to a foundation for an offshore structure and a method for installing a foundation according to the preambles of the appended independent claims.

BACKGROUND OF THE INVENTION

Various foundations are known in the prior art to provide support for an offshore structure, such as an oil and gas platform, by transferring its load through compressible strata or water onto layers of soil or rock that have sufficient bearing capacity and suitable settlement characteristics. The foundations can be classified into different types according to their basic structure. The most commonly used foundation types are a monopile foundation, a gravity foundation and a suction caisson.

The monopile foundation utilises a single pile to support the load of an offshore structure. The pile must be driven deep into the ground to withstand the lateral loading due to the wind and wave forces. The gravity foundation comprises a large and heavy concrete element with a plurality of towers on which an offshore platform is built. The basic structural principle of this type of foundation is that the large weight of the structure results in large vertical stresses below the foundation, which enable to withstand the large horizontal shear stresses that are generated by the wind and wave loading. The suction caisson consists of a cylindrical shell with a top plate and various fittings that allow water to be pumped into and out of the shell. The suction caisson has an open bottom that allows soil to enter the interior of the shell when the caisson is installed. The suction caisson is sealed at the top while in use so that the lifting forces generate a pressure differential, which holds the caisson in place in the ground. An offshore structure can be attached directly or by using one or more piles to the suction caisson, depending on whether the top plate is above or below the water level.

A problem associated with known offshore foundations is that they are difficult and time-consuming to install into the ground. Another problem associated with the known offshore foundations is that they are difficult to remove from the ground. Yet another problem of the known offshore foundations is that they are not versatile, but instead can only be used in some specific offshore applications.

OBJECTIVES OF THE INVENTION

It is the main objective of the present invention to reduce or even eliminate the prior art problems presented above.

It is an objective of the present invention to provide a foundation for an offshore structure. In more detail, it is an objective of the invention to provide an offshore foundation that is easy and quick to install into the ground. It is a further objective of the invention to provide an offshore foundation that can be easily removed from the ground. It is yet a further objective of the invention to provide an offshore foundation that is versatile, allowing it to be used in various offshore applications.

It is also an objective of the present invention to provide an easy and quick method for installing a foundation for an offshore structure.

In order to realise the above-mentioned objectives, the foundation and the installation method according to the invention are characterised by what is presented in the characterising portions of the appended independent claims. Advantageous embodiments of the invention are described in the dependent claims.

DESCRIPTION OF THE INVENTION

A foundation according to the invention for an offshore structure comprises a wall forming a closed perimeter and having an upper end and a lower end, and a top deck attached to the upper end of the wall, the top deck and the wall defining a downwardly open hollow space. In the foundation according to the invention the wall comprises a plurality of wall sections, each wall section comprising a first elongated hollow body having an upper end and a lower end, the lower end being closed by an end member provided with an opening, and a second elongated hollow body having an upper end and a lower end, the second elongated hollow body being arranged inside the first elongated hollow body so that the lower end of the second elongated hollow body extends through the opening and is attached to the end member.

The foundation according to the invention can be used as a foundation for various offshore structures, such as oil and gas platforms, heliports, jetties, wind turbines, energy islands, and bridges. The foundation is installed into the ground, such as the seabed, in such a manner that the top of the foundation is located above or below the water level. The foundation according to the invention is especially suitable for shallow water applications. An offshore structure is meant to be attached on the top deck of the foundation. The top deck is attached to the wall that functions as a load-bearing element transferring the load of the offshore structure into the ground. The wall can have different forms depending on the application. Preferably, the wall is a cylindrical wall. The top deck and the wall can be made of steel, stainless steel, or any other suitable material.

The foundation comprises the downwardly open hollow space that is defined by the wall and the top deck. The hollow space is open at the bottom of the foundation. The open bottom allows water to enter the hollow space when the foundation is arranged in water. The foundation is preferably dimensioned in such a manner that the foundation can float. This enables the foundation to be towed to a desired installation site. The draught of the foundation can be changed by transferring air into or out of the downwardly open hollow space. If the foundation does not float, the foundation can be provided with floating means, which are removed at the installation site. At the installation site the foundation can be lowered relative to the water level by removing air from the downwardly open hollow space. As the air is removed, the lower end of the wall comes into contact with the seabed and begins to penetrate into it if the air removal is continued. The foundation can be raised from the seabed by transferring air or water into the downwardly open hollow space.

The wall comprises a plurality of wall sections, which are attached to one another, for example, by welding or by interlocking sections. The wall sections can be made of steel, stainless steel, or any other suitable material. The number of wall sections can be, for example, 2-100. Preferably, the number of wall sections is 5-75, and more preferably 20-40.

The wall section has two elongated hollow bodies inside each other. The first elongated hollow body forms the outer body and the second elongated hollow body the inner body of the wall section. Preferably, the first and second elongated hollow bodies are essentially parallel with each other and have essentially the same length. Preferably, the second elongated hollow body is arranged concentrically with the first elongated hollow body.

The first elongated hollow body can be tubular and have, for example, a circular or rectangular cross section. The first elongated hollow body can be, for example, a pipe, a tube or a stiffened shell. The lower end of the first elongated hollow body is closed by the end member, which comprises the opening through which the lower end of the second elongated hollow body passes. The end member is preferably attached inside the lower end of the first elongated hollow body. The end member is attached to the first and second elongated hollow bodies in a watertight manner.

The end member is preferably convergent towards the point where the end member is attached to the second elongated hollow body. The upper end of the first elongated hollow body is preferably closed by another end member provided with an opening through which the upper end of the second elongated hollow body is arranged to extend. The second elongated hollow body is attached to this end member. The wall thickness of the first elongated hollow body can be, for example, 10-100 mm.

The second elongated hollow body can be tubular and have, for example, a circular or rectangular cross section. Preferably, the second elongated hollow body has a circular cross section. The second elongated hollow body can be a pipe or a tube. The lower end of the second elongated hollow body is open allowing soil to be conveyed through the second elongated hollow body when the foundation is installed into the ground. The upper end of the second elongated hollow body is open, but it can be closed by a cover after the foundation has been installed into the ground. The cover prevents any material from passing through the second elongated hollow body. The wall thickness of the second elongated hollow body can be, for example, 5-50 mm.

The wall sections are utilised in the installation of the foundation as follows. When the foundation has been lowered on the seabed, the soil under the wall section is removed with a bottom pump that is attached to the lower end of the second elongated hollow body, and the soil is conveyed away through the second elongated hollow body. The space between the first elongated hollow body and the second elongated hollow body can be filled with the removed soil or other suitable material through the upper end of the wall section. As the soil is removed from underneath the wall sections, the wall penetrates into the seabed. The soil is removed until the foundation is at a desired depth. When needed, the foundation can be detached from the seabed, for example, by pumping water through the second elongated hollow bodies underneath the wall sections. As the water is pumped underneath the wall sections, the foundation starts to rise from the seabed.

An advantage of the foundation according to the invention is that it is easy and quick to install into the ground. Another advantage of the foundation according to the invention is that it can be easily removed from the ground. Yet another advantage of the foundation according to the invention is that it can be reused. Yet another advantage of the foundation according to the invention is that it is versatile, allowing it to be used in various offshore applications.

According to an embodiment of the invention the wall is a cylindrical wall. The outer diameter of the cylindrical wall can be, for example, 5-200 m. An advantage of the cylindrical wall is its mechanical strength.

According to an embodiment of the invention the foundation comprises means for transferring fluid into and out of the downwardly open hollow space. The fluid can be air and/or water. The foundation that is arranged in water can be lowered by transferring fluid out of the downwardly open hollow space and raised by transferring fluid into the downwardly open hollow space. The means for transferring fluid may comprise, for example, a pump that is configured to pump air or water through the top deck into and out of the downwardly open hollow space. An advantage of the means for transferring fluid into and out of the downwardly open hollow space is that it facilitates the installation of the foundation into the ground.

According to an embodiment of the invention the wall section comprises a bottom pump attached to the lower end of the second elongated hollow body for removing soil, and a riser pipe arranged inside the second elongated hollow body for carrying the soil, a lower end of the riser pipe being attached to the bottom pump. The bottom pump is releasably attached to the second elongated hollow body so that it can be removed through the second elongated hollow body after the foundation has been installed into the ground. The bottom pump is attached to the lower end of the second elongated hollow body with a connector that provides a watertight connection between the bottom pump and the second elongated hollow body. The riser pipe carries the soil through the second elongated hollow body. An upper end of the riser pipe can be attached to a tank outside the wall section for receiving the removed soil. The riser pipe can be made of steel, stainless steel, or any other suitable material. The riser pipe can be a reinforced hose.

According to an embodiment of the invention the bottom pump comprises a cutter unit for loosening the soil. The cutter unit may comprise rotating cutting or stirring blades driven for example by a hydraulic motor. An advantage of the cutter unit is that it facilitates the installation of the foundation into the ground.

According to an embodiment of the invention the bottom pump comprises a water spraying unit for fluidising the soil. The water spraying unit may comprise nozzles to distribute pressurised water. An advantage of the water spraying unit is that it facilitates the installation of the foundation into the ground.

According to an embodiment of the invention the foundation comprises a plurality of air cushions. The air cushions can be built-in or attached to the wall. The air cushions provide buoyancy to the foundation and thus enable the towing of the foundation to a desired installation site at the sea. At the installation site, the air cushions are emptied, and the foundation is installed into the seabed. One or more of the wall sections can be provided with an air cushion. The number of air cushions can be, for example, 2-100.

According to an embodiment of the invention the wall section comprises a plurality of outer supports attached to an outer surface of the first elongated hollow body. The outer supports may comprise plates, arms or rods. The outer supports may extend perpendicularly outwards from the outer surface of the first elongated hollow body. The outer supports are preferably attached to a position where the outer supports become at least partly embedded into the ground when the foundation is installed. The number of the outer supports can be, for example, 2-100 or 100-200. An advantage of the outer supports is that they protect against the lateral forces due to wind and/or waves as well as ice.

According to an embodiment of the invention the wall section comprises a plurality of inner supports attached between an inner surface of the first elongated hollow body and an outer surface of the second elongated hollow body. The inner supports may comprise plates, arms or rods. The inner supports may extend perpendicularly between the inner surface of the first elongated hollow body and the outer surface of the second elongated hollow body. The inner supports can be arranged at various locations along the length of the wall section. At each location, a plurality of inner supports can be arranged symmetrically around the second elongated hollow body. The number of the inner supports can be, for example, 2-50 or 50-100. An advantage of the inner supports is that they increase the rigidity of the wall section.

According to an embodiment of the invention the end member comprises a conical portion. The conical portion can be arranged so that it opens away from the wall section. An advantage of the conical portion is that it directs the soil towards the lower end of the second elongated hollow body.

According to an embodiment of the invention the foundation comprises means for heating and cooling the wall. The means for heating and cooling the wall may comprise heat pipes, which are arranged inside the second elongated hollow bodies after the foundation has been installed into the ground. An advantage of the means for heating and cooling the wall is that they enable to keep the temperature of the wall in a desired temperature range. For example, with the means for heating and cooling, the ground and/or the water surrounding the wall can be prevented from freezing or the ground and/or the water surrounding the wall can be artificially frozen.

According to an embodiment of the invention the foundation comprises means for vibrating the wall. The vibrating means can comprise an eccentric-type vibrator. The vibrating means can be configured to vibrate the wall at a frequency of 0.5-50 Hz. An advantage of the vibrating means is that they facilitate the installation of the foundation into the ground.

The present invention also relates to a method for installing a foundation according to the invention into the ground. The method according to the invention comprises arranging the foundation to float in water, towing the foundation to an installation site, removing fluid from the downwardly open hollow space, using a plurality of bottom pumps attached to the lower ends of the second elongated hollow bodies to remove soil, and using a plurality of riser pipes arranged inside the second elongated hollow bodies to carry the soil.

In the method according to the invention the foundation is arranged to float in water and then towed to the installation site at the sea. Preferably, the foundation is dimensioned in such a manner that the foundation can float without additional floating means. For the towing, the foundation is set to a desired height relative to the water level by transferring air into or out of the downwardly open hollow space. The foundation can be provided with floating means, which are removed at the installation site.

At the installation site, the foundation is lowered by removing air and water from the downwardly open hollow space until the lower end of the wall comes into contact with the seabed and begins to penetrate into it. When the foundation has been lowered on the seabed, the soil under the wall sections is removed by using the bottom pumps that are attached to the lower ends of the second elongated hollow bodies. The soil is carried away through the riser pipes, which are arranged inside the second elongated hollow bodies. As the soil is removed from underneath the wall sections, the wall penetrates into the seabed. The soil is removed until the foundation is at a desired depth. The foundation can be levelled with the aid of the bottom pumps.

An offshore structure can be attached to the foundation before or after the foundation is installed into the ground.

An advantage of the method according to the invention is that the foundation can be easily and quickly installed into the ground.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

The exemplary embodiments presented in this text and their advantages relate by applicable parts to the foundation as well as the installation method according to the invention, even though this is not always separately mentioned.

DETAILED DESCRIPTION OF THE DRAWINGS

Figure 1:
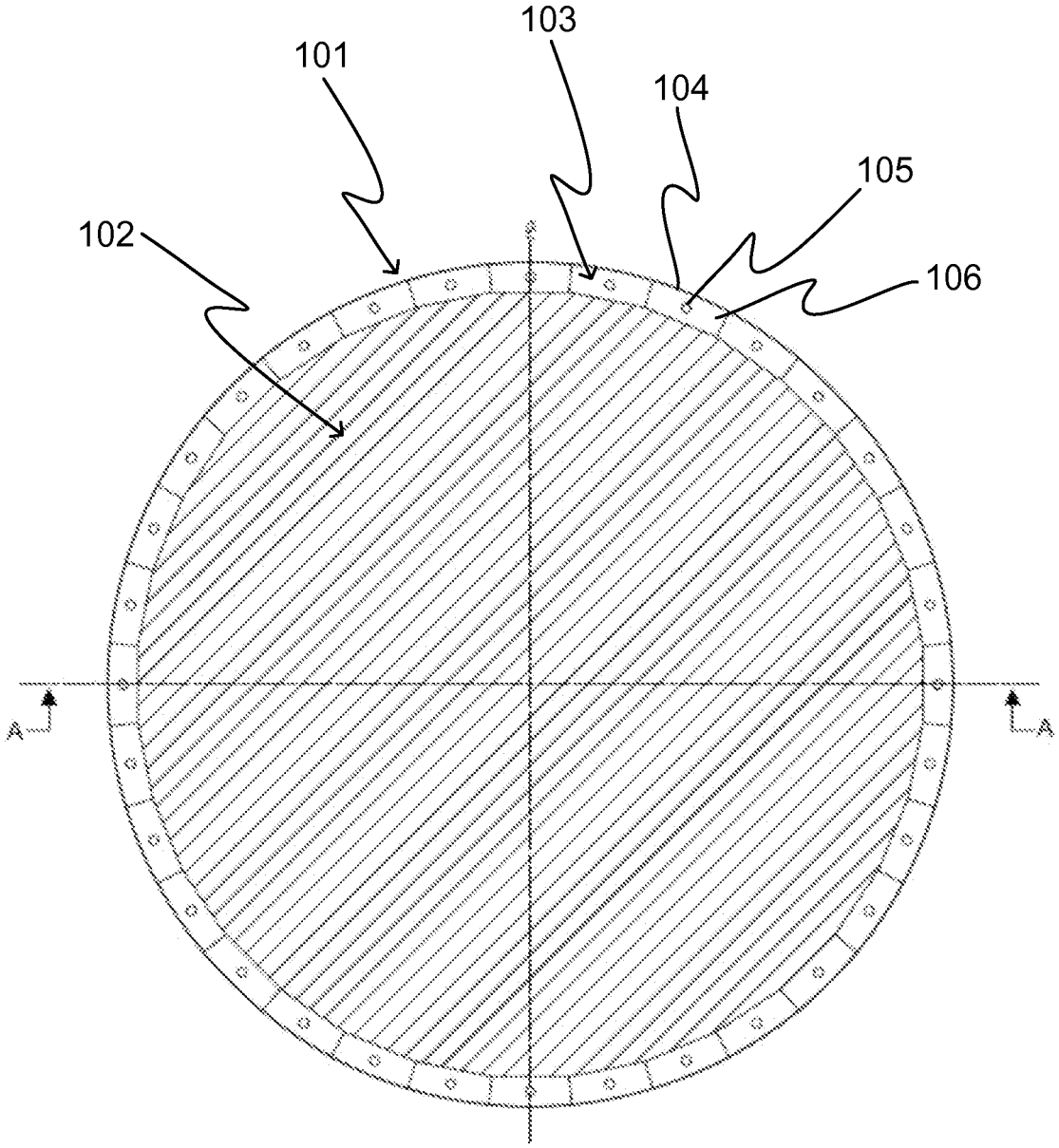
FIG. 1 illustrates a foundation according to an embodiment of the invention for an offshore structure.

FIG. 1 illustrates a foundation according to an embodiment of the invention for an offshore structure. The foundation is shown from above.

The foundation comprises a cylindrical wall 101 and a top deck 102 that is attached to an upper end of the cylindrical wall 101. The cylindrical wall 101 and the top deck 102 define a downwardly open hollow space (not shown in FIG. 1), i.e., a hollow space that is open at the bottom of the foundation. An offshore structure is meant to be attached on the top deck 102. The cylindrical wall 101 functions as a load-bearing element that transfers the load of the offshore structure into the ground, such as the seabed.

The cylindrical wall 101 consists of wall sections 103, which are attached to one another so that they form a closed perimeter. Each wall section 103 comprises a first elongated hollow body 104 and a second elongated hollow body 105 that is arranged inside the first elongated hollow body 104. An upper end of the first elongated hollow body 104 is closed by an upper end member 106 that is provided with an opening through which an upper end of the second elongated hollow body 105 passes. A lower end of the first elongated hollow body 104 is closed by a lower end member (not shown in FIG. 1) that is provided with an opening through which a lower end of the second elongated hollow body 105 passes. The upper end member 106 and the lower end member seal the space between the first elongated hollow body 104 and the second elongated hollow body 105.

Figure 2A:
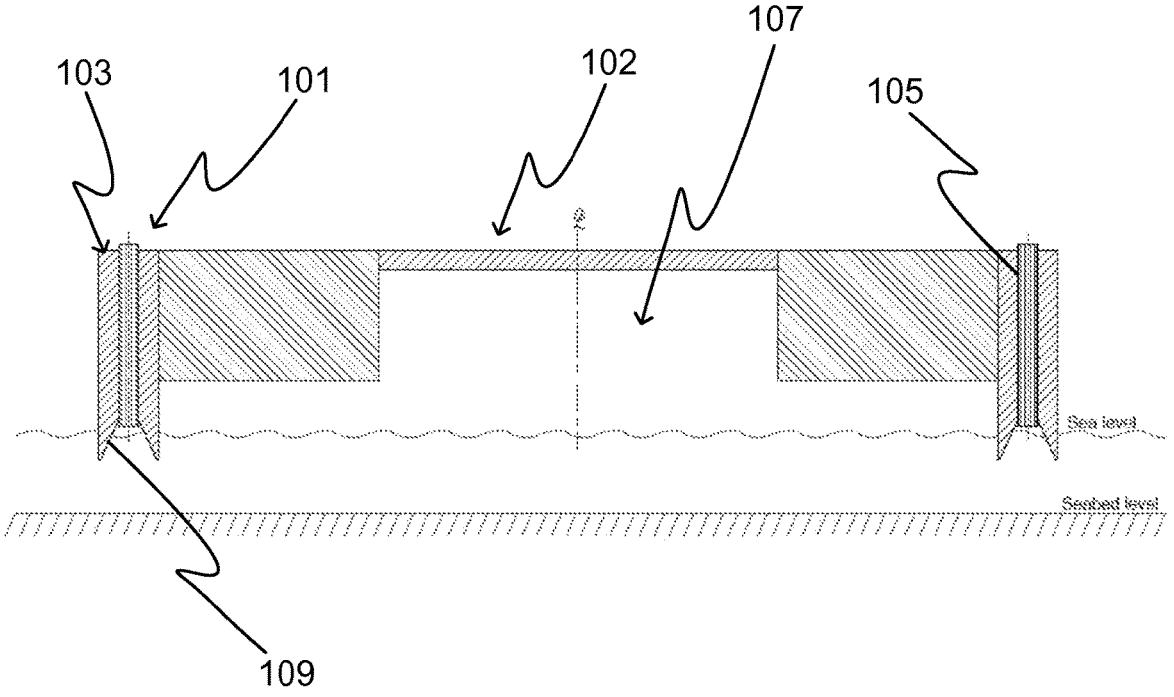
FIGS. 2A-2B illustrate the installation of the foundation of FIG. 1.
Figure 2B:
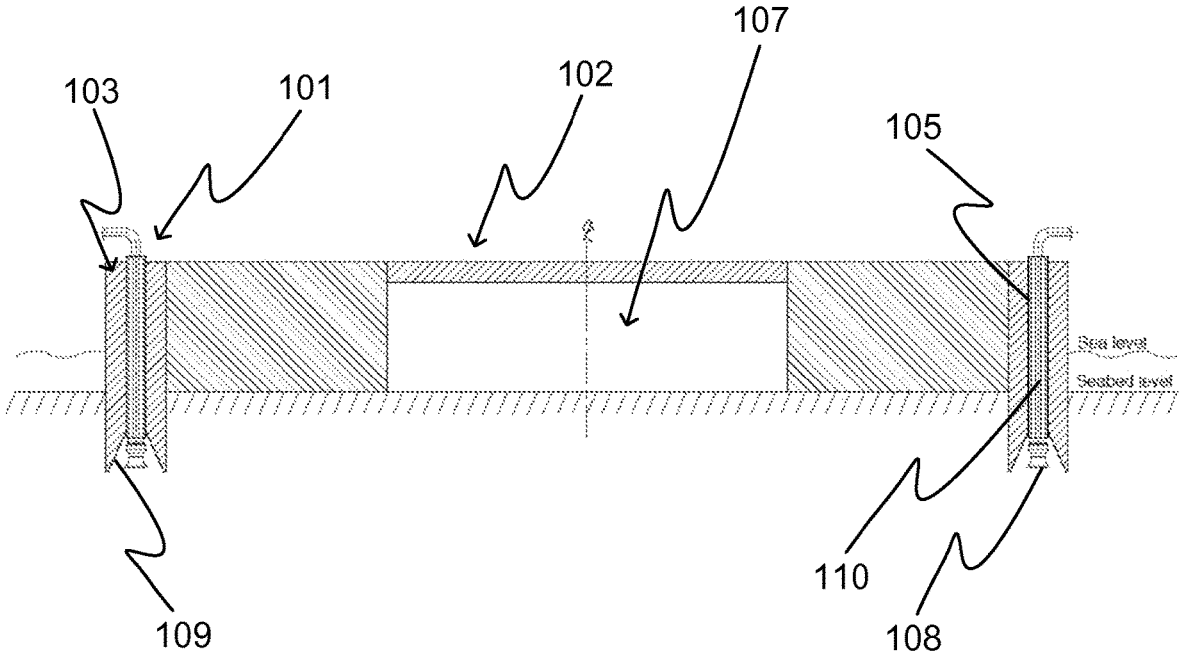

FIGS. 2A-2B illustrate the installation of the foundation of FIG. 1 into the seabed. The foundation is shown as a cross sectional view taken along the line A-A of FIG. 1.

In FIG. 2A, the foundation is shown floating in water. The foundation is arranged in such a manner that its bottom is towards the seabed. The foundation has been set at a desired height relative to the sea level by controlling the amount of air inside the downwardly open hollow space 107.

At a desired installation site, the foundation is lowered by removing air and water from the downwardly open hollow space 107 until the lower end of the cylindrical wall 101 comes into contact with the seabed and begins to penetrate into it. After the cylindrical wall 101 has been lowered on the seabed, the soil under the wall sections 103 is removed by using bottom pumps 108 that are attached to the lower ends of the second elongated hollow bodies 105. The lower end member 109 has a conical portion that directs the soil towards the bottom pump 108. The soil is carried away through riser pipes 110, which are arranged inside the second elongated hollow bodies 105. As the soil is removed from underneath the wall sections 103, the cylindrical wall 101 penetrates into the seabed. The soil is removed until the underside of the top deck 102 comes into contact with the seabed. The top of the installed foundation is located above the sea level. The installed foundation is shown in FIG. 2B.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. A foundation for an offshore structure, comprising:

a wall forming a closed perimeter and having an upper end and a lower end, and a top deck attached to the upper end of the wall, the top deck and the wall defining a downwardly open hollow space, wherein the wall comprises a plurality of wall sections, each wall section comprising a first elongated hollow body having an upper end and a lower end, the lower end being closed by an end member provided with an opening, and a second elongated hollow body having an upper end and a lower end, the second elongated hollow body being arranged inside the first elongated hollow body so that the lower end of the second elongated hollow body extends through the opening and is attached to the end member.

2. The foundation according to claim 1, wherein the wall is a cylindrical wall.

3. The foundation according to claim 1, wherein the foundation comprises means for transferring fluid into and out of the downwardly open hollow space.

4. The foundation according to claim 1, wherein the wall section comprises a bottom pump attached to the lower end of the second elongated hollow body for removing soil, and a riser pipe arranged inside the second elongated hollow body for carrying the soil, a lower end of the riser pipe being attached to the bottom pump.

5. The foundation according to claim 4, wherein the bottom pump comprises a cutter unit for loosening the soil.

6. The foundation according to claim 4, wherein the bottom pump comprises a water spraying unit for fluidising the soil.

7. The foundation according to claim 1, wherein the foundation comprises a plurality of air cushions.

8. The foundation according to claim 1, wherein the wall section comprises a plurality of outer supports attached to an outer surface of the first elongated hollow body.

9. The foundation according to claim 1, wherein the wall section comprises a plurality of inner supports attached between an inner surface of the first elongated hollow body and an outer surface of the second elongated hollow body.

10. The foundation according to claim 1, wherein the end member comprises a conical portion.

11. The foundation according to claim 1, wherein the foundation comprises means for heating and cooling the wall.

12. The foundation according to claim 1, wherein the foundation comprises means for vibrating the wall.

13. A method for installing a foundation according to claim 1, wherein the method comprises:

arranging the foundation to float in water, towing the foundation to an installation site, removing fluid from the downwardly open hollow space, using a plurality of bottom pumps attached to the lower ends of the second elongated hollow bodies to remove soil, and using a plurality of riser pipes arranged inside the second elongated hollow bodies to carry the soil.

* * * * *